US005135215A

United States Patent [19]

Takimoto et al.

[11] Patent Number: 5,135,215

[45] Date of Patent: Aug. 4, 1992

[54] ADJUSTABLE SHEET REVERSER THAT COMPENSATES FOR SHEET MISALIGNMENT

[75] Inventors: Kazushi Takimoto; Takashi Kotani, both of Osaka, Japan

[73] Assignee: Mita Industrial Co., Ltd., Osaka, Japan

[21] Appl. No.: 757,618

[22] Filed: Sep. 11, 1991

[30] Foreign Application Priority Data

Sep. 11, 1990 [JP] Japan ..... 2-241735

[51] Int. Cl.[5] ..... B65H 29/60

[52] U.S. Cl. ..... 271/301; 271/251; 271/291

[58] Field of Search ..... 271/185-186, 271/251, 285, 286, 291, 301

[56] References Cited

U.S. PATENT DOCUMENTS 4,162,786 7/1979 Bullock ..... 271/251
4,486,014 12/1984 Enoguchi et al. ..... 271/251
4,487,407 12/1984 Baldwin ..... 271/252
4,712,786 12/1987 Looney ..... 271/286
4,984,779 1/1991 Iwasaki ..... 271/291
5,054,768 10/1991 Iseda ..... 271/291

FOREIGN PATENT DOCUMENTS 205263 8/1988 Japan ..... 271/301

*Primary Examiner*—Robert P. Olszewski
*Assistant Examiner*—Steven M. Reiss
*Attorney, Agent, or Firm*—Cushman, Darby & Cushman

[57] ABSTRACT

The present invention is a device to be attached to a copy machine or the like to automatically reverse the original document. The invention is designed to account for misaligned or displaced portions of the copying machine which can result in poor quality reproductions when the original document is reversed for dual side copying. The present invention incorporates an adjustable reversion path to correct for obliquely fed originals.

14 Claims, 5 Drawing Sheets

ADJUSTABLE SHEET REVERSER THAT COMPENSATES FOR SHEET MISALIGNMENT

BACKGROUND OF THE INVENTION

The present invention relates to an automatic original reversing conveyor which may be attached to an apparatus such as a copying machine or the like in order to reverse an original.

Conventionally, an automatic original reversing conveyor has a configuration as shown in FIG. 6 (PRIOR ART) in which a conveyor unit 2 transfers an original document onto a mounting plate 1. A reversion unit 7 for reversing the original is provided on the outlet side of the conveyor unit 2.

A reversing guide roller 8 is positioned at the center of the reversion unit 7. Rollers 14 are disposed in the periphery of and to assist the reversing guide roller 8. Furthermore, a first, second, third and fourth conveyor guide 3, 4, 5', and 6, respectively, are disposed consecutively from the outlet roller 21 side of the conveyor unit 2 to form a reversion path S. The third conveyor guide 5' is integrally formed with a cover portion for covering the first, second and fourth conveyor guides 3, 4 and 6.

The change-over pawl 10 diverts the movement of the original between the reversion and discharge paths. In addition, a photosensor 12 detects the passage of an original through the reversion path S; likewise, a photosensor 13 detects the discharge of an original from a discharge outlet 11. The discharge outlet 11 is for final output of an original document after the process is complete.

The operation of an automatic original reversing conveyor configured in this manner will now be explained. An original document which is positioned on the mount plate 1 is sent to the first conveyor guide 3 by a conveyor belt 22 of the conveyor unit 2. The original is then directed by the conveyor guides 4 and 5' as it is forwarded by the action of the reversing guide roller 8 and rollers 14 through the reversion path S. In order to reverse the original document, the change-over pawl 10 is switched to the upper position to send the original downward. Subsequently, the fact that the original has been reversed is detected by the photosensor 12 at the position of the fourth conveyor guide 6. The reversed original is then placed once again on the mount plate 1 by the action of the conveyor belt 22.

Generally, such an automatic original reversing conveyor is manufactured such that a paper feed unit for sending-out an original, a conveyor unit for mounting the original onto a mount plate, and a reversion unit for reversing the original are all attached to an apparatus body cover. Therefore, each of these parts has a specific tolerance or separation clearance which must be maintained to ensure an optimum quality process. For example, if these various parts or units are not accurately positioned, the original is inevitably displaced during reversion which results in unacceptable reproductions.

Even for an unitary device, unlike the components assembled in FIG. 6, an original is often reversed with an oblique displacement because of the inaccuracy of the tolerance among the parts.

SUMMARY OF THE INVENTION

In consideration of the problems detailed above, an object of the present invention is to provide an automatic original reversing conveyor in which an original can be straightened when reversed even if the assembled parts of the apparatus are displaced or misaligned.

According to the present invention, the automatic original reversing conveyor includes a paper feed portion for feeding an original, a conveyor portion for conveying the original sent out from the paper feed portion to a mount plate, and a reversion path for reversing the original sent out from the conveyor. The unique advantage of the present invention is that the reversion path has a correction mechanism in which the right and left reversion path lengths of the original document can be adjusted in order to align the document. Therefore, the original can be reversed straight even if it was initially misaligned.

DETAILED DESCRIPTION OF THE INVENTION

Figure 5:
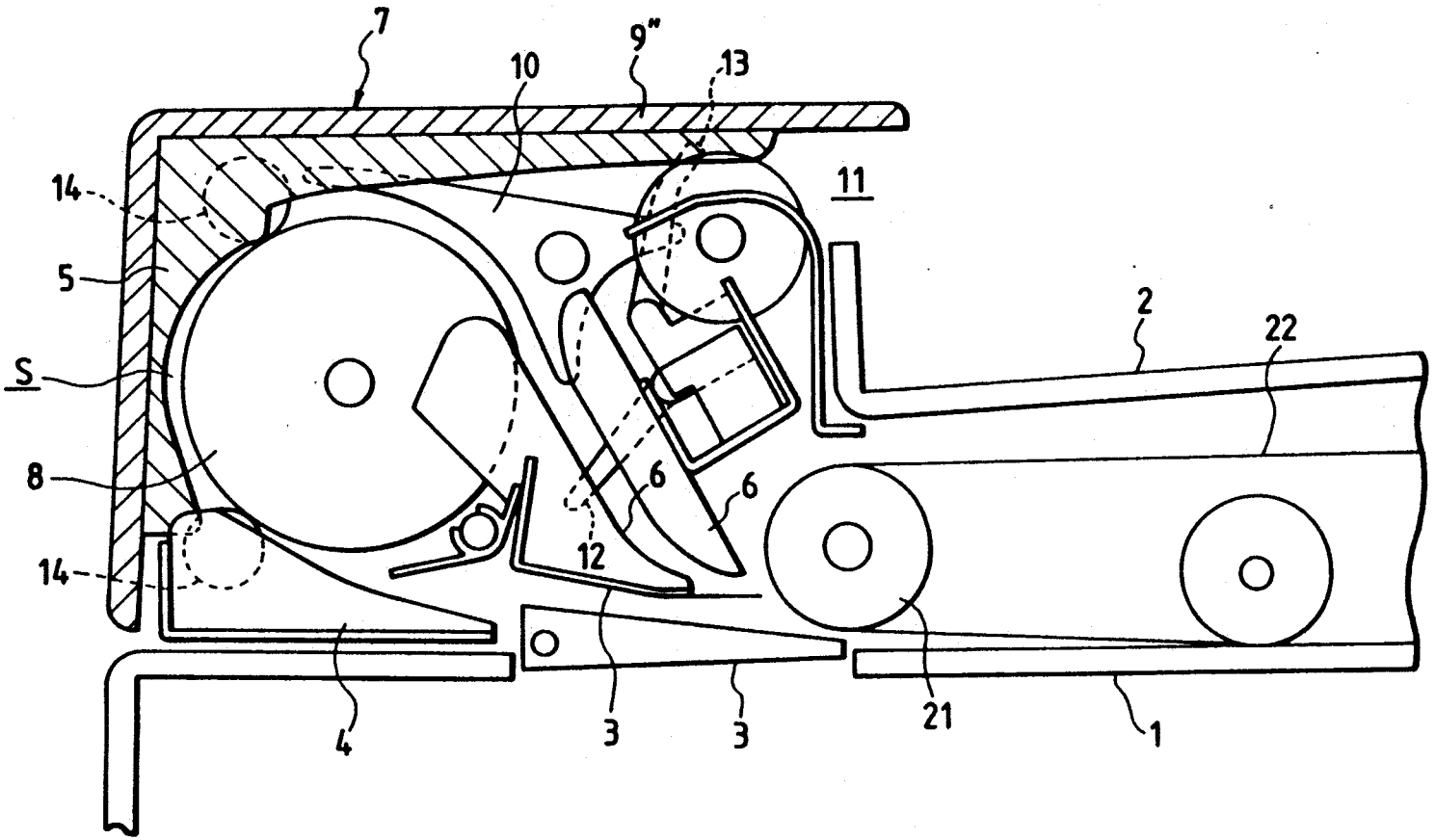
FIG. 5 is a sectional schematic view showing a first embodiment of the automatic original reversing conveyor according to the present invention.
Figure 6:
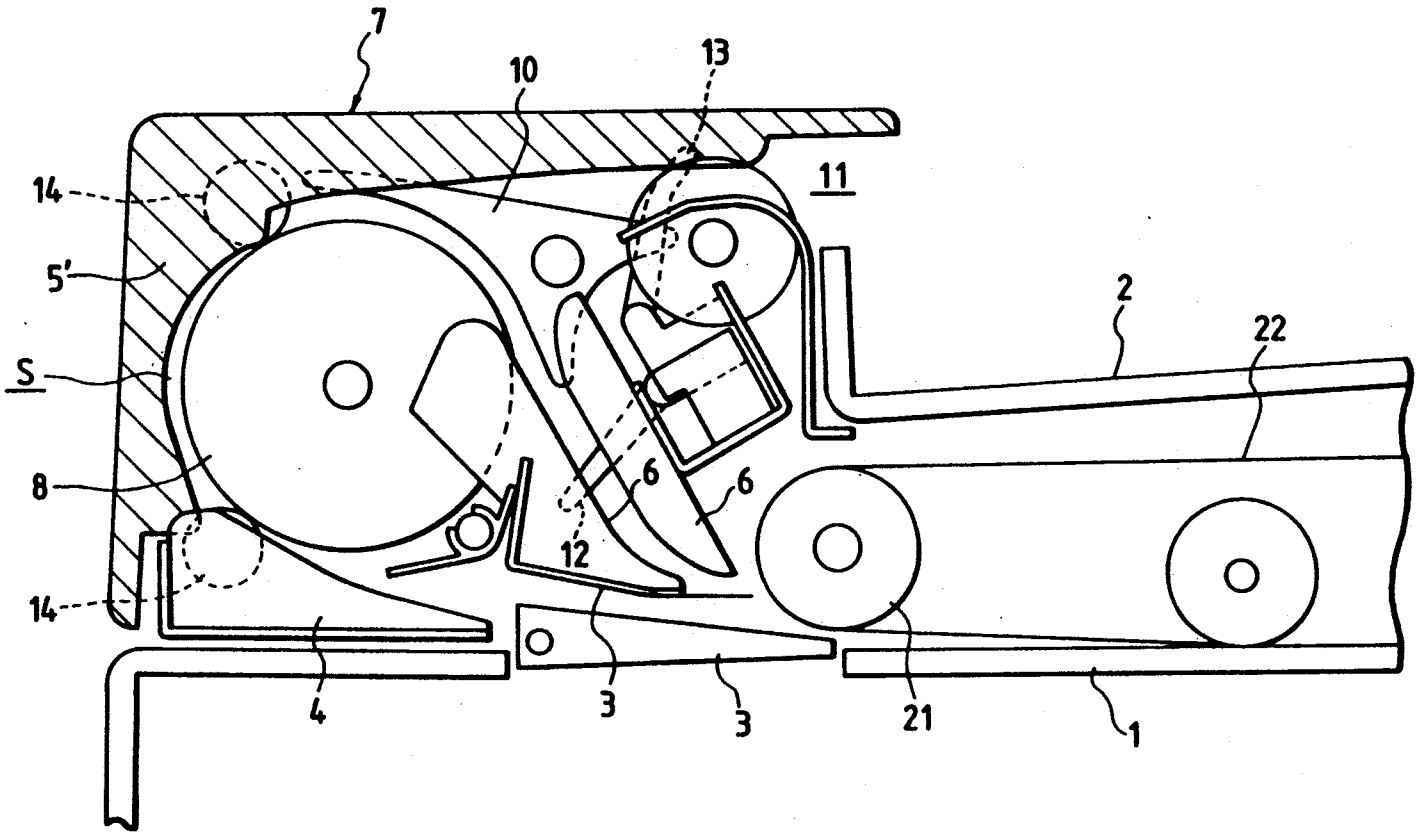
FIG. 6 PRIOR ART
FIG. 6 (Prior Art) is a sectional schematic view showing a conventional automatic original reversing apparatus.

The first embodiment of the present invention will be explained with reference to FIG. 5. The first embodiment of the present invention includes the same components as the foregoing conventional apparatuses shown in FIG. 6. Therefore, the reference numerals in FIG. 5 correspond to the description of the parts which accompanied FIG. 6.

Figure 2:
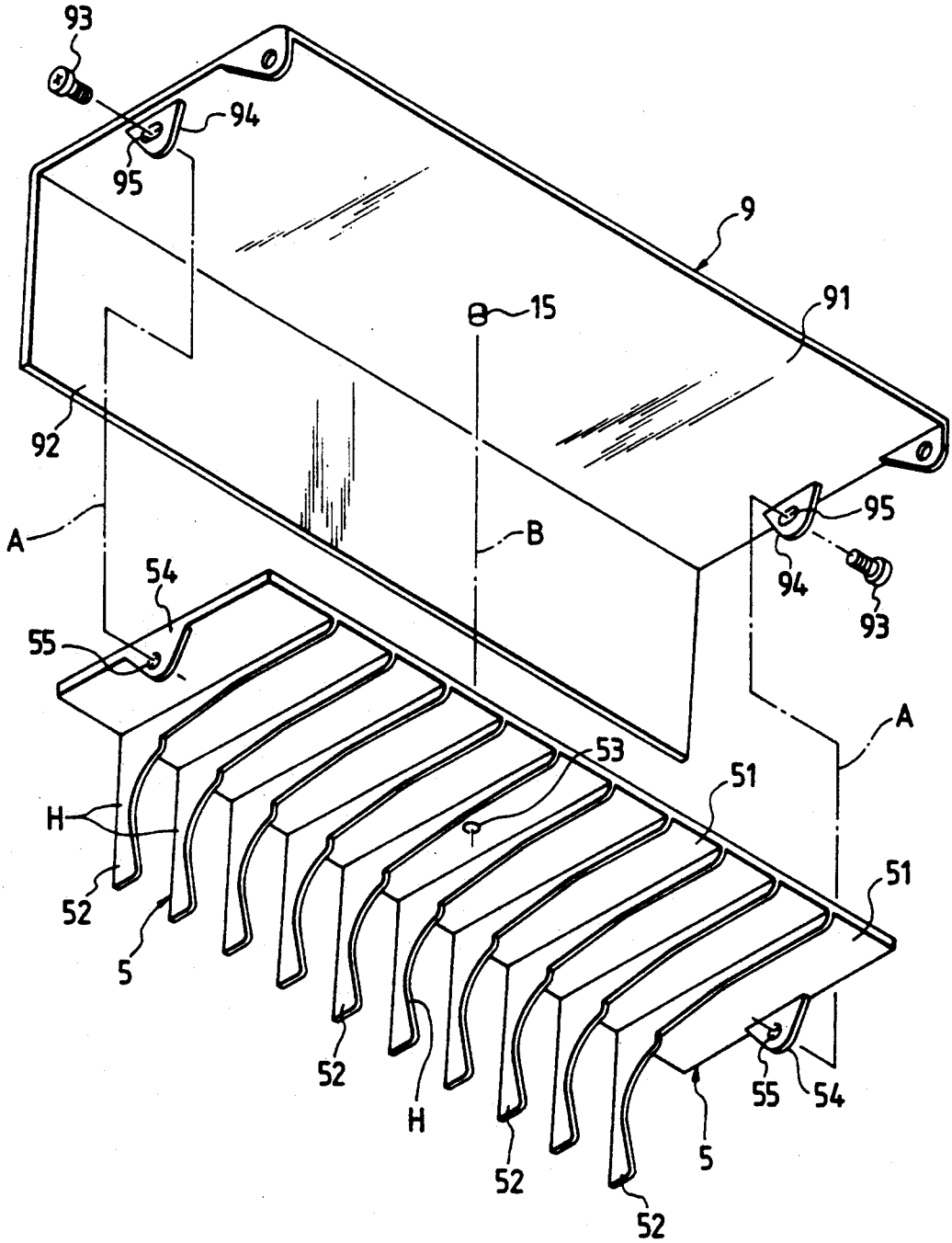
FIG. 2 is an exploded perspective view showing the outer cover and the third conveyor guide of the second embodiment.

In this embodiment, an outer cover 9" is attached and covers the four conveyor guides 3, 4, 5, and 6. The outer cover 9" is separate from the conveyor guide 5 such that each can move independently. However, the conveyor guide 5 is temporarily mated to the outer cover 9" at a predetermined position. This is accomplished when a pin 15 on the cover 9" is inserted through a hole 53 (FIG. 2). Likewise, a screw 93 is used to temporarily join the brackets 94 and 54 on each side of the ceiling plates 92 and 51. Adjusting the position of the screw 93 in the brackets 94 and 54 alters the reversion path lengths to align an original document.

Figure 1:
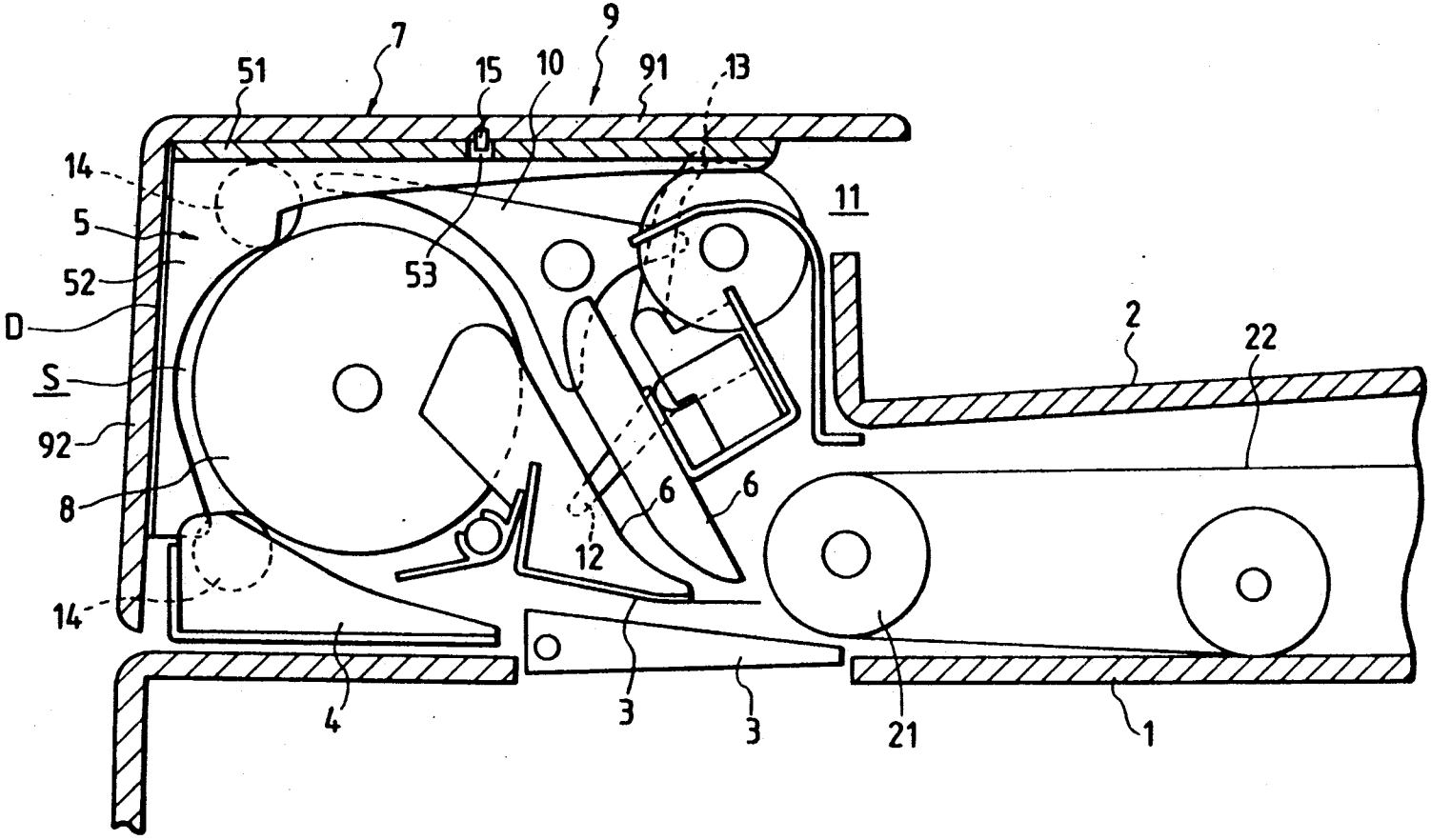
FIG. 1 is a sectional schematic view of a second embodiment of the automatic original reversing conveyor according to the present invention.

Similarly, FIG. 1 is a sectional schematic view of a conveyor and a reversion unit of the second embodiment of the present invention. The conveyor unit 2 transfers an original onto an attached mount plate 1, and a reversion unit 7 reverses the path direction of the original. A reversing guide roller 8 is provided at the center of the reversion unit 7; rollers 14 are positioned on the periphery of the reversing guide roller 8 to assist the movement of the original in the reversion path S. The reversion path S is further formed by four conveyor guides 3, 4, 5, and 6 which are positioned consecutively from the outlet roller 21. An outer cover 9 is attached to cover the conveyor guides 3, 4, 5, and 6.

In order to reverse the original document, the change-over pawl 10 is switched to the upper position to send the original downward. Subsequently, the fact that the original has been reversed is detected by the photosensor 12 at the position of the fourth conveyor guide 6. The reversed original is then positioned once again on the mount plate 1 by the action of the conveyor belt 22. If the change-over pawl 10 were in the down position, the original would be fed toward a discharge outlet 11 and detected by a photo sensor 13.

Description of specific portions of the first embodiment will now be explained with reference to FIG. 2. The third conveyor guide 5 has a set of ribs 52 extending from the lower surface of its ceiling plate 51 so as to form a curved surface H. A hole 53 is formed through the center of the ceiling plate 51. The brackets 54 on each end of the ceiling plate 51 have a screw hole 55.

Likewise, the outer cover 9 has a rear plate 92 which extends downward from a ceiling plate 91. A pin 15 projects downward from the center of the lower surface of the ceiling plate 91. The brackets 94 on each end of the ceiling plate 91 have an elongated hole 95. The pin 15 is inserted into the hole 53 as shown by a one-dot chained line B. Furthermore, the right and left brackets 94 are aligned with the right and left brackets 54, respectively, and a screw 93 is inserted through each of the pairs of holes 95 and 55 as shown by the one-dot chained lines A. The parts are designed so that a predetermined gap D exists between the ribs 52 and the rear plate 92 as shown in FIG. 1.

Figure 3:
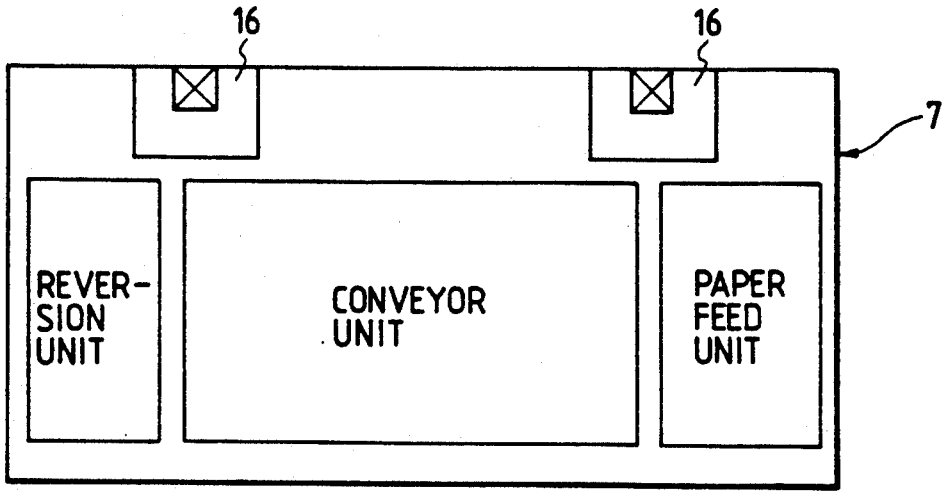
FIG. 3 is a plan schematic view of the reversion path, the conveyor portion, and the paper feed portion of the second embodiment.

The method of adjusting the length of the reversion path S in the foregoing embodiment will now be illustrated. The pin 15, the hole 53, the brackets 54 and 94, the screw holes 55, the elongated holes 95, and the screws 93 constitute the mechanism for adjusting the reversion path lengths. The paper feed unit, the conveyor unit, and the reversion unit are all tentatively assembled on an upper portion of a copying machine body. FIG. 3 is a plan schematic view showing this arrangement. An original document is initially set in the paper feed unit of the automatic original reversion unit 7 to perform first side copying. Consequently, if the original is feed obliquely, balancers 16 on the rear-side end of the reversion unit 7 can be adjusted to thereby align the paper feed unit with the mount plate 1.

For second side copying the original must be reversed by the reversion unit. Therefore, if the original is obliquely displaced or misaligned it can be straightened by adjusting the reversion unit. This adjustment is accomplished by loosening the screws 93 (FIG. 2) and slightly rotating the conveyor guide 5 about the pin 15 relative to the outer cover 9.

Figure 4:
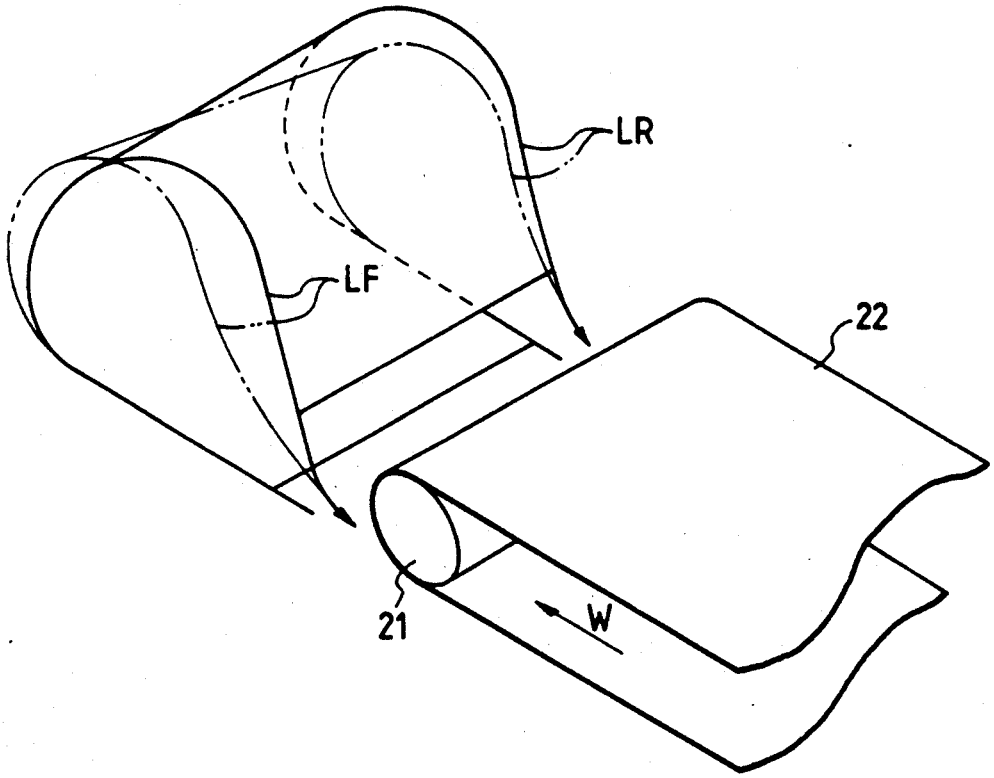
FIG. 4 is a perspective schematic view to explain the conveyor portion of the second embodiment.

Then, the screws 93 are re-fastened securing the outer cover 9 relative to the conveyor guide 5. As a result of this adjustment, the left-hand side ribs 52 as shown in FIG. 2 are moved to the downstream side (or the upstream side) and, conversely, the right-hand side ribs 52 are moved to the upstream side (or the downstream side). In other words, the left (front) and right (rear) reversion path lengths LF and LR of the reversion unit 7 are altered as shown by two-dotted chain lines in FIG. 4 in regard to the direction W of an original. The reversion path lengths are those perpendicular to the correct outlet line of the conveyor unit 2.

By adjusting the conveyor guide 5 in this way, the left and right reversion path lengths LF and LR can be altered to be equal or unequal. The reversion path lengths should be kept equal if the original is delivered to the reversion unit in an aligned state. In this way the process of reversing the original will not introduce any oblique displacement.

Conversely, if the original is delivered to the reversion unit out of alignment, the reversion path lengths LF an LR can le adjusted to be unequal to correct this misalignment. In short, according to the present invention, it is sufficient if the direction of an original is adjusted to be straight regardless if it is delivered to the reversion unit aligned or not.

Even though the third conveyor guide 5 is configured to rotate in the foregoing embodiments, the present invention is not limited in this way. An automatic original reversing conveyor according to the present invention may be designed without a rotating member similar to the conveyor guide 5. In other words, it is sufficient if the right and left path lengths are adjustable.

Likewise, although the conveyor guide 5 rotates relative to the outer cover 9 in the foregoing embodiments, the present invention is not limited in this manner either. The outer cover 9 may be integrally formed with the conveyor guide 5 so that in adjusting the reversion path lengths LR and LF the outer cover 9 and the conveyor guide 5 move as an integral unit.

Moreover, although the paper feed portion, the conveyor portion, and the reversion unit are related as individual units in the foregoing description of the present invention, the portions are not always formed separately and may be integrally constructed.

Therefore, the reversion unit of the automatic original reversing conveyor according to the present invention has an adjustment mechanism in which the right and left reversion path lengths can be altered. In this way the advantages that for double side copying an original can be reversed in an aligned state and that an original for single side copying remains aligned are clearly realized.

What is claimed is:

1. An automatic original reversing conveyor comprising:

a paper feed means for feeding an original document, a conveyor means for conveying the original document from the paper feed means to a mount plate, and a reversion means for reversing the original document sent out from the conveyor means, the reversion means characterized by an adjustment mechanism in which a right and a left reversion path length in the reversion means are adjustable on the basis of the orientation of the original document.

2. An automatic original reversing conveyor according to claim 1, wherein the reversion means includes roller member and conveyor guide member so as to form a reversing path, the conveyor guide member includes a first conveyor guide which has curved surfaces disposed at outer side of said reversing path, and said first guide is adjustable in order to alter the right and left reversion path lengths.

3. An automatic original reversing conveyor according to claim 2, wherein the reversion means further comprises an outer cover for covering said first conveyor guide so that said first conveyor guide is adjustable with respect to said outer cover.

4. An automatic original reversing conveyor according to claim 3, in which said first conveyor guide includes a supporting plate which is rotatably supported with respect to said outer cover.

5. An automatic original reversing conveyor according to claim 4, in which a pin is provided on one of said supporting plate of said first conveyor guide and said outer cover, and a fitting hole into which said pin is fitted is provided on the other one.

6. An automatic original reversing conveyor according to claim 3, in which said outer cover is integrally provided with a ceiling plate, and said first conveyor guide includes a ceiling plate which is rotatably supported with respect to said ceiling plate of said outer cover.

7. An automatic original reversing conveyor according to claim 4, in which each end portion of said supporting plate and each end portion of said outer cover are adjustable secured through a securing means.

8. An automatic original reversing conveyor according to claim 7, in which said securing means comprises a screw hole provided on at least one of said supporting plate and said outer cover, and a screw which is threadedly engaged with said screw hole.

9. An automatic original reversing conveyor according to claim 7, in which said securing means comprises first brackets provided on the end portions of said supporting plate and second brackets provided on the end portions of said outer cover in such a manner that said first brackets are adjustable with respect to said second brackets.

10. An automatic original reversing conveyor according to claim 9, in which a slit is formed on at least one of said first bracket and said second bracket in such a manner said first bracket and second brackets are secured by a screw to be inserted into said slit.

11. An automatic original reversing conveyor according to claim 6, wherein right and left brackets each having a screw hole are formed on each end of said ceiling plate of said first conveyer guide, right and left brackets each having an elongated hole are formed on each end of said ceiling plate of said outer cover, said right and left brackets are aligned with the right and left brackets, respectively, and a screw is inserted through each of the pairs of holes.

12. An automatic original reversing conveyor according to claim 6, wherein said first conveyor guide has a set of ribs extending from a lower surface of said ceiling plate so as to form a curved surface.

13. An automatic original reversing conveyor according to claim 12, wherein a predetermined gap exists between the ribs and a rear plate extending downward from said ceiling plate of said outer cover.

14. An automatic original reversing conveyor according to claim 7, in which said outer cover is integrally provided with a ceiling plate which is confronted with said supporting plate, and said supporting plate is a ceiling plate.

* * * * *